US007900903B2

(12) United States Patent
Caron

(10) Patent No.: US 7,900,903 B2
(45) Date of Patent: Mar. 8, 2011

(54) HOPPER MOUNTING MECHANISM

(75) Inventor: Glen Roger Caron, Greenland, NH (US)

(73) Assignee: Goss International Americas, Inc., Durham, NH (US)

( * ) Notice: Subject to any disclaimer, the term of this patent is extended or adjusted under 35 U.S.C. 154(b) by 453 days.

(21) Appl. No.: 11/894,532

(22) Filed: Aug. 20, 2007

(65) Prior Publication Data

US 2008/0044271 A1 Feb. 21, 2008

Related U.S. Application Data

(60) Provisional application No. 60/839,106, filed on Aug. 21, 2006.

(51) Int. Cl.
*B65H 39/04* (2006.01)
*B65H 1/00* (2006.01)

(52) U.S. Cl. ..... 270/52.2; 270/52.21; 270/52.22; 270/52.26

(58) Field of Classification Search ..... 270/52.16, 270/52.19, 52.2, 52.21, 52.22, 52.26, 52.29
See application file for complete search history.

(56) References Cited

U.S. PATENT DOCUMENTS

| | | | | |
|---|---|---|---|---|
| 4,177,979 | A * | 12/1979 | Orsinger et al. | 270/52.16 |
| 5,171,125 | A | 12/1992 | Kleinhen | |
| 5,364,224 | A | 11/1994 | Padgett | |
| 5,582,219 | A | 12/1996 | Claar et al. | |
| 6,057,514 | A | 5/2000 | Maguire | |
| 6,082,724 | A | 7/2000 | Kahlig et al. | |
| 6,561,505 | B2 * | 5/2003 | Takaki et al. | 271/10.12 |
| 6,733,225 | B1 * | 5/2004 | Barnett et al. | 414/420 |
| 2005/0017101 | A1 | 1/2005 | Truan et al. | |
| 2006/0103064 | A1 | 5/2006 | Sittinger et al. | |

* cited by examiner

*Primary Examiner* — Leslie A Nicholson, III
(74) *Attorney, Agent, or Firm* — Davidson, Davidson & Kappel, LLC

(57) ABSTRACT

A hopper is provided including a hopper sidewall and a hopper shoe, the hopper shoe secured to the sidewall, the hopper being pivotable with respect to the hopper shoe when the hopper is secured to a hopper base. A hopper also is provided including a hopper sidewall, a hopper shoe and a spring-loaded clamp for securing the hopper shoe to the hopper sidewall, the spring-loaded clamp including a bolt for securing the spring-loaded clamp to a hopper base. A method is also provided.

18 Claims, 4 Drawing Sheets

HOPPER MOUNTING MECHANISM

This claims the benefit of U.S. Provisional Application No. 60/839,106 filed Aug. 21, 2006, and hereby incorporated by reference herein.

BACKGROUND

The present invention relates to printing presses and more particularly to hoppers.

Gathering devices such as perfect binders, saddle stitchers and mailroom inserters may use hoppers or feeders to collect sheet material. A saddle stitcher or perfect binder may for example collect folded printed materials fed from hoppers or feeders onto a saddle or perfect binder conveyor, respectively, to form a magazine or other printed product. In the context of the present application, the term hopper and feeder are used synonymously.

U.S. Pat. No. 5,171,125 purportedly discloses moving a hopper and a stack of sheet material from an upright orientation to a tilted orientation. As the hopper and stack of sheet material are tilted, a lower end portion of the stack of sheet material is moved along an upwardly inclined ramp into engagement with a sheet material feed assembly.

U.S. Pat. No. 6,082,724, hereby incorporated by reference herein, describes a signature collating apparatus such as an inserter having a plurality of hoppers delivering sheet materials to receiving locations on a conveyor.

U.S. Publication No. 2006/0103064 purportedly discloses modular signature feeders that include a frame having a base configured to enable the modular signature feeder to be removably attached to another modular signature feeder or a signature transfer assembly associated with a signature collation feeder assembly.

SUMMARY OF THE INVENTION

In accordance with an embodiment of the present invention, a hopper includes a hopper sidewall and a hopper shoe. The hopper shoe is secured to the sidewall. The hopper is pivotable with respect to the hopper shoe when the hopper is secured to a hopper base.

In accordance with another embodiment of the present invention, a hopper includes a hopper sidewall, a hopper shoe, and a spring-loaded clamp for securing the hopper shoe to the hopper sidewall, the spring-loaded clamp including a bolt for securing the spring-loaded clamp to a hopper base.

In accordance with an embodiment of the present invention, a method for moving a hopper includes pivoting the hopper about a pivot point of the hopper, sliding the hopper off a first hopper base and onto a movable hopper base, and moving the hopper and movable hopper base.

DETAILED DESCRIPTION

In conventional gathering device designs, hoppers are rigidly clamped to steel tubes. Removal and installation of the hopper to a hopper base was a long process. Hopper clamps were physically removed and an overhead lifting device was needed to move the hopper.

Furthermore, the height of the hopper is not adjustable in previous printing press designs. The height of the hopper is governed by vacuum opening components. When vacuum opening components are not used it may be advantageous for the hopper to sit closer to the gathering chain.

Figure 1:
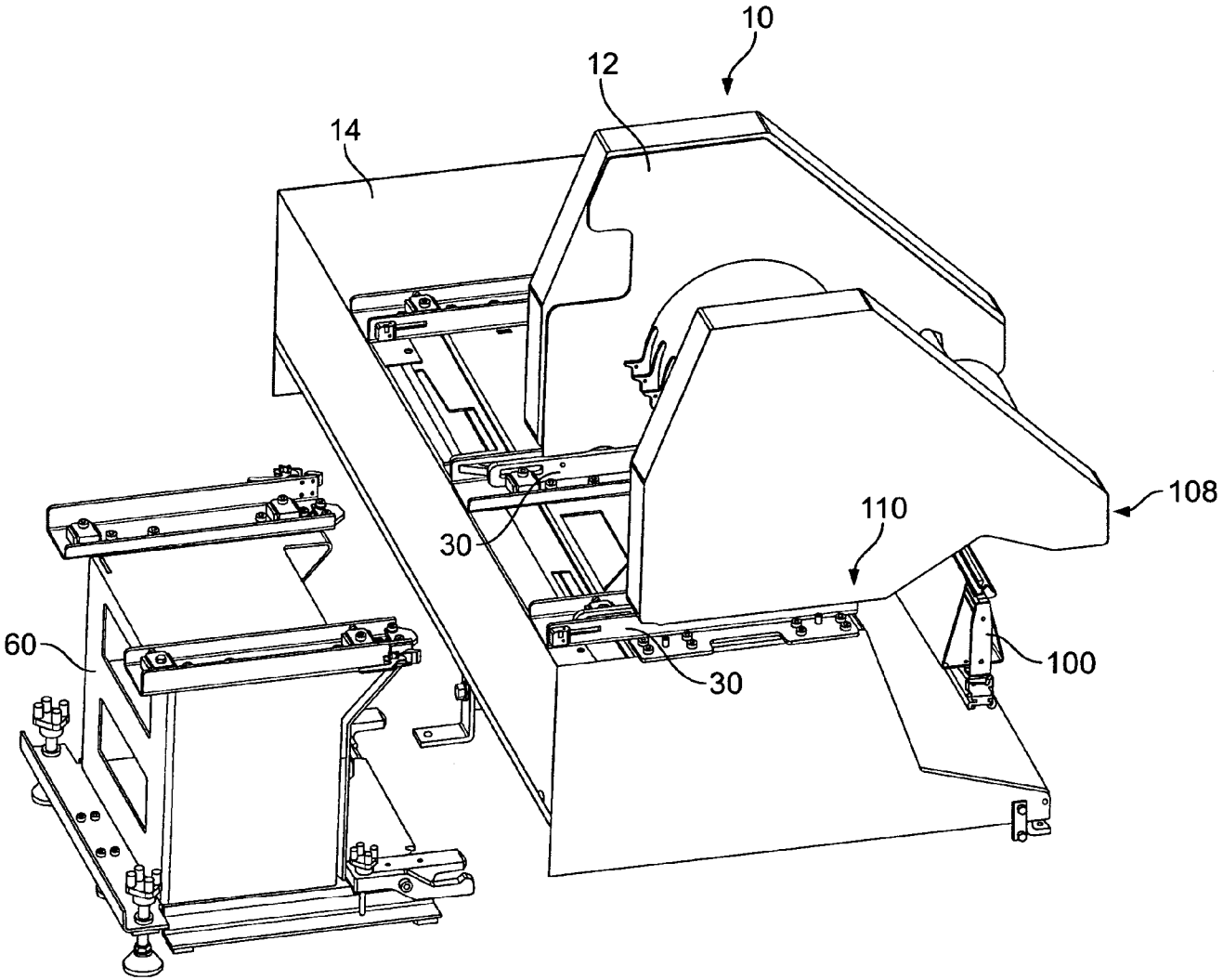
FIG. 1 shows a hopper, hopper base and mobile hopper base.

FIG. 1 shows a hopper 10 mounted on a hopper base 14. A mobile hopper base 60 is also shown. Hopper 10 is movable between hopper base 14 and a mobile base 60. Mobile base 60 may be transported with hopper 10 for example, to relocate hopper 10 or transport hopper 10 for repairs. Hopper 10 includes hopper shoe 30, hopper sidewall 12, a nose section 108 extending over a gathering conveyor, such as a gathering chain 100, and a middle section 110 where hopper 10 is secured to hopper base 14. Hopper 10 is positioned over gathering chain 100 in the operating position to feed products at gathering chain 10. The mechanism within hopper 10 for feeding products onto gathering chain 100 can be of any conventional construction and will not be discussed herein.

Figure 2:
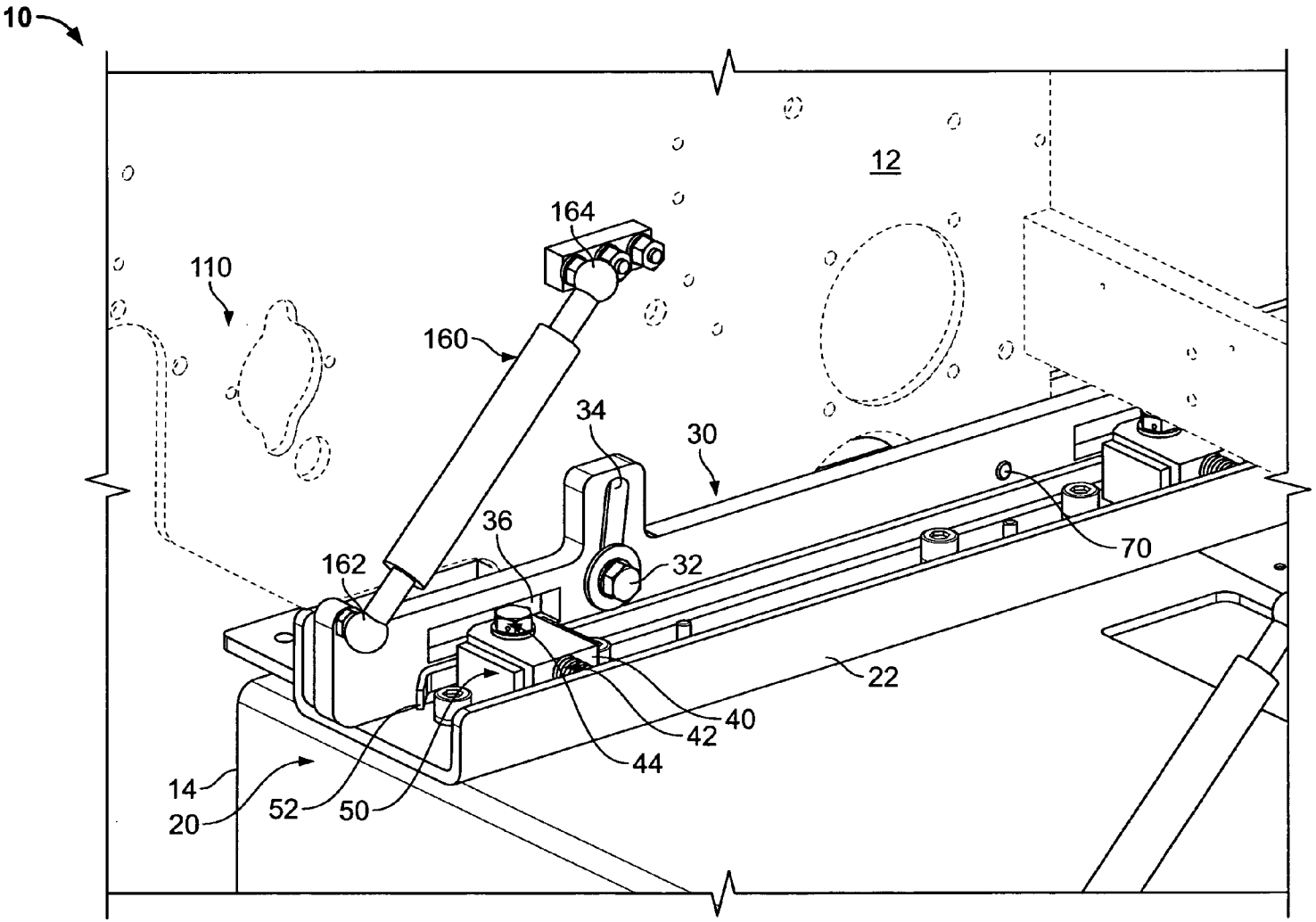
FIG. 2 shows a hopper and hopper mounting assembly according to the present invention.

FIG. 2 shows a hopper 10 and a hopper mounting assembly 20. A hopper shoe 30 is pinned to sidewall 12 by a fastener, for example, a clamping bolt 32, via vertical slot 34. Clamping bolt 32 provides a rigid connection between hopper shoe 30 and sidewall 12 and reduces vibration. Hopper shoe 30 also has a longitudinal slot 36 which engages a spring-loaded clamp 40.

A pneumatic cylinder 160 is also attached at one end 162 to hopper shoe 30 and at the other end 164 to hopper sidewall 12. Pneumatic cylinder 160 can support a weight of hopper 10 and pivots hopper 10 about a pivot point 70. End 162 is located in the middle section 110 of hopper 10. When actuated, pneumatic cylinder 160 lifts hopper 10 up via sidewall 12. Clamping bolt 32 slides up in vertical slot 34, while hopper shoe 30 remains fixed to hopper base 14. Hopper 10 pivots about pivot point 70 raising the nose section 108 and middle section 110. Thus, the position of front section 110 may be adjusted to accommodate operating needs. Hopper 10 may be pivoted up, for example, when vacuum components are needed, or pivoted down, for example, to sit close to the inserter chain when vacuum components are not employed, ensuring a reliable drop to the inserter chain. Hopper 10 may be pivoted for example, 150 or less.

In addition, nose section 108 of hopper 10 may be pivoted up prior to removal of hopper 10 from hopper base 14 so hopper 10 clears gathering chain 100 (FIG. 1). In a typical operating position, nose section 108 may snag gathering chain 100 if hopper 10 is pulled horizontally off hopper base 60.

Figure 3:
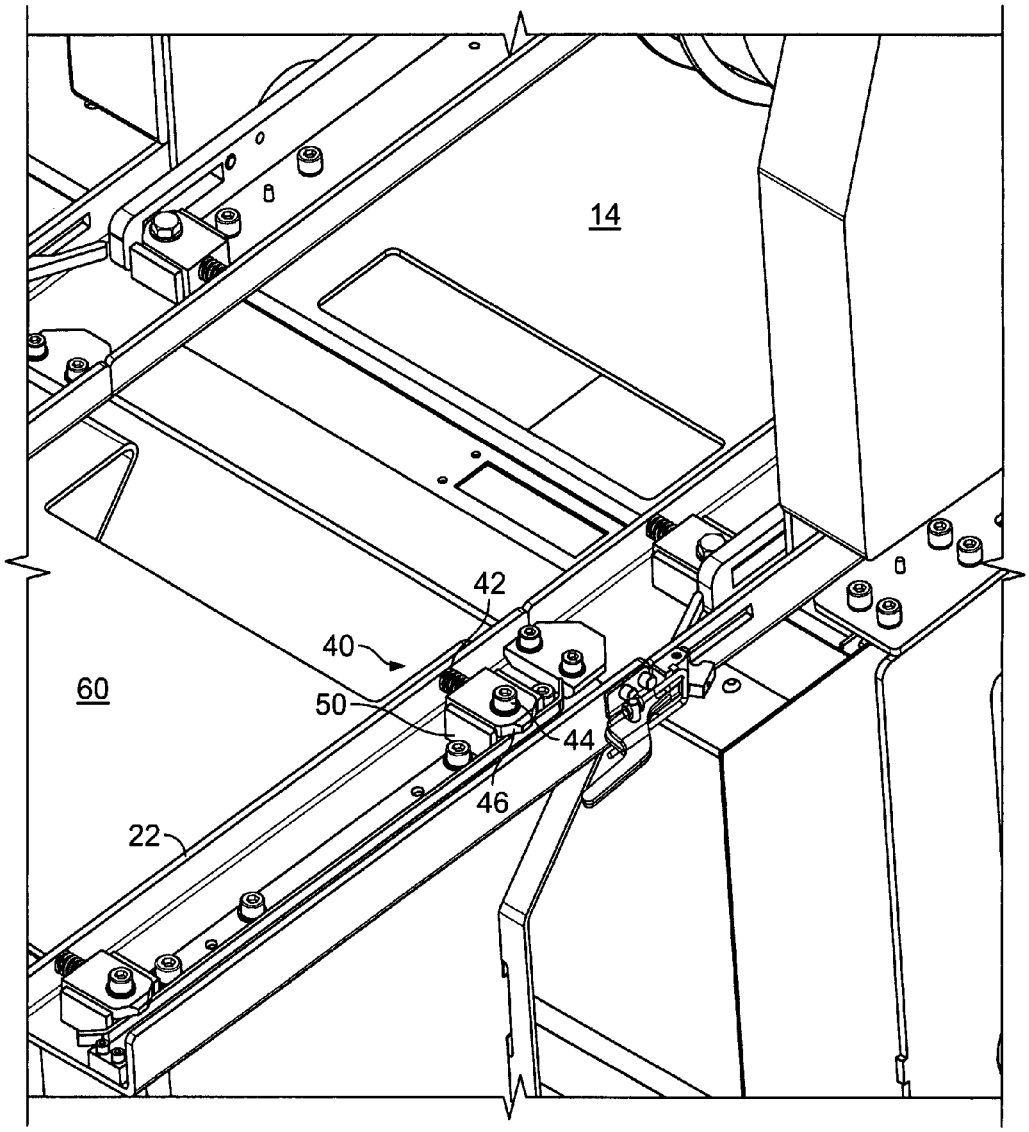
FIG. 3 shows the hopper mounting assembly of FIG. 2.

FIGS. 2 and 3 show hopper mounting assembly 20 including a bracket 22, spring-loaded clamp 40 and a guide 50. Spring-loaded clamp 40 includes a spring 42, bolt 44 and chamfered edge 46. Spring 42 biases spring-loaded clamp 40 into engagement with longitudinal slot 36 in hopper shoe 30. The bolt 44 screws into bracket 22 to secure hopper 10 to hopper base 14. To move hopper 10 from base 14, bolt 44 needs to be loosened for example, ½ to 1 turn. As hopper 10 is pulled off hopper base 14, chamfered edge 46 contacts an edge of longitudinal slot 36 which pushes spring-loaded clamp 40 back into guide 50. Hopper shoe 30 continues to slide past spring-loaded clamp 40 until hopper 20 is pulled off base 14 and onto a mobile hopper base 60. Once hopper 10 is properly positioned on mobile base 60, spring 42 pushes clamp 40 into longitudinal slot 36 to lock hopper shoe 30 onto mobile base 60. Bolt 44 can then be tightened to secure hopper 10 onto mobile base 60. An additional guide 52 may be provided for aligning hopper 10 on hopper base 14 or mobile base 60. The guide may be made of, for example, steel. Thus, spring-loaded clamp 40 and hopper shoe 30 may significantly reduce the time required for installation and removal of hopper 10.

Figure 4:
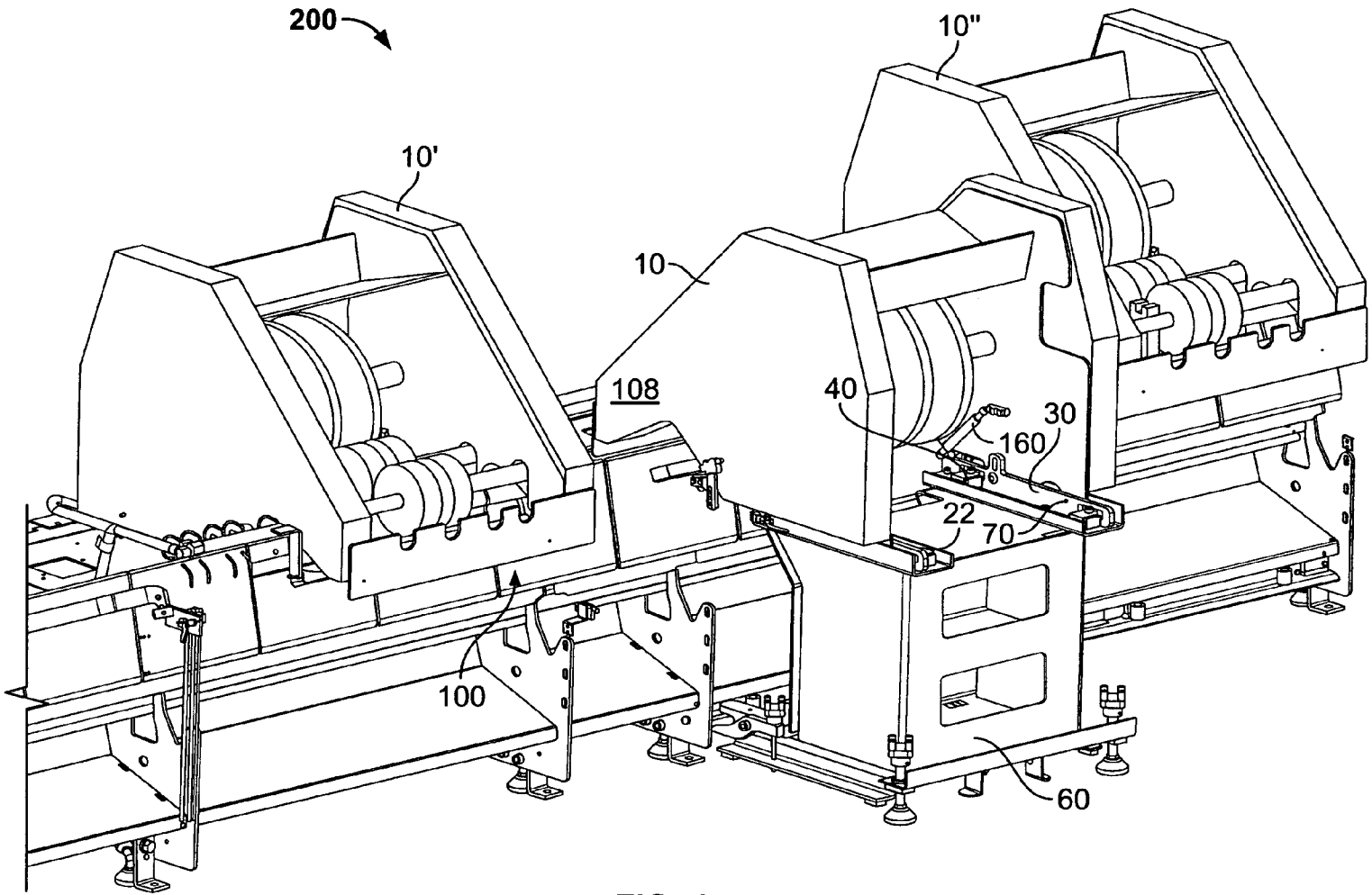
FIG. 4 shows the hopper mounted on the mobile base.

FIG. 4 shows a gathering device 200 including a plurality of hoppers 10, 10', 10". Hopper 10 is mounted onto mobile base 60 via brackets 22, spring-loaded clamps 40 and hopper shoe 30. Hopper 10 has been moved from the typical feeder side position to the operator side, allowing, for example, hopper 10 to feed reverse lap signatures with less difficulty. By lifting hopper 10 up and pivoting hopper 10 at pivot point 70, nose section 108 may be positioned over gathering chain 100 as desired.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A hopper comprising:

a hopper sidewall; and a hopper shoe, the hopper shoe secured to the sidewall at a pivot;

the hopper being pivotable with respect to the hopper shoe at the pivot when the hopper is secured to a hopper base;

the hopper shoe securing the hopper to the hopper base via a bracket.

2. The hopper as recited in claim 1 further comprising a pneumatic cylinder having opposing ends connected to the hopper shoe and hopper sidewall.

3. The hopper as recited in claim 2 wherein the hopper is pivoted 15° or less.

4. The hopper as recited in claim 2 wherein the hopper shoe includes a vertical slot.

5. The hopper as recited in claim 4 wherein the vertical slot engages a fastener for securing the hopper shoe to the hopper sidewall.

6. The hopper as recited in claim 1 wherein the hopper shoe includes a slot engaging a clamp for securing the hopper to the hopper base.

7. The hopper as recited in claim 1 wherein the hopper shoe includes a longitudinal slot.

8. The hopper as recited in claim 7 wherein the longitudinal slot engages a clamp for securing the hopper to the hopper base.

9. The hopper as recited in claim 8 wherein the clamp has a chamfered edge.

10. The hopper as recited in claim 8 wherein the clamp is spring loaded.

11. The hopper as recited in claim 8 wherein the hopper shoe includes a vertical slot.

12. The hopper as recited in claim 11 wherein the vertical slot engages a fastener for securing the hopper shoe to the hopper sidewall.

13. The hopper as recited in claim 1 wherein the hopper shoe is connected to the hopper sidewall via a bolt and the pivot.

14. The hopper as recited in claim 1 wherein the hopper shoe is slid off a hopper base to remove the hopper from the hopper base.

15. A hopper comprising:

a hopper sidewall; and a hopper shoe, the hopper shoe secured to the sidewall;

the hopper being pivotable with respect to the hopper shoe when the hopper is secured to a hopper base, the hopper shoe securing the hopper to the hopper base via bracket, the hopper shoe being secured to the bracket via a clamp.

16. The hopper as recited in claim 15 wherein the clamp has a chamfered edge.

17. The hopper as recited in claim 15 wherein the clamp is spring loaded.

18. The hopper as recited in claim 15 wherein the bracket is secured to the hopper base via a bolt.

* * * * *